US005698007A

United States Patent [19]

Schmitt

[11] Patent Number: 5,698,007

[45] Date of Patent: Dec. 16, 1997

[54] PROCESS FOR AGGLOMERATING PARTICULATE MATERIAL

[75] Inventor: James Schmitt, Eveleth, Minn.

[73] Assignee: Akzo Nobel NV, Arnhem, Netherlands

[21] Appl. No.: 373,289

[22] PCT Filed: Aug. 6, 1992

[86] PCT No.: PCT/US92/06551

§ 371 Date: Jan. 20, 1995

§ 102(e) Date: Jan. 20, 1995

[87] PCT Pub. No.: WO94/03648

PCT Pub. Date: Feb. 17, 1994

[51] Int. Cl.[6] ..... C22B 1/244

[52] U.S. Cl. ..... 75/772; 75/321

[58] Field of Search ..... 75/772, 321; 106/154.1, 106/205, 208, 209

[56] References Cited

U.S. PATENT DOCUMENTS

| | | | |
|---|---|---|---|
| 3,374,115 | 3/1968 | Frank et al. | 127/29 |
| 3,852,059 | 12/1974 | Bruen et al. | 75/3 |
| 4,288,245 | 9/1981 | Roorda et al. | 75/0.5 |
| 4,402,736 | 9/1983 | Graham | 75/0.5 |
| 4,597,797 | 7/1986 | Roorda et al. | 106/194 |
| 4,684,549 | 8/1987 | Allen et al. | 427/221 |
| 4,728,537 | 3/1988 | Allen | 427/221 |
| 4,751,259 | 6/1988 | Roe et al. | 524/52 |
| 4,863,512 | 9/1989 | Banyai et al. | 75/5 |
| 4,898,611 | 2/1990 | Gross | 75/3 |
| 4,919,711 | 4/1990 | Banyai et al. | 75/321 |
| 4,948,430 | 8/1990 | Banyai et al. | 75/321 |
| 5,000,783 | 3/1991 | Dingeman et al. | 75/321 |
| 5,112,582 | 5/1992 | Polizzotti | 423/27 |
| 5,171,361 | 12/1992 | Dingeman et al. | 75/772 |
| 5,186,915 | 2/1993 | Polizzotti | 423/29 |
| 5,294,250 | 3/1994 | Panigraphy et al. | 106/209 |

FOREIGN PATENT DOCUMENTS

| | | | |
|---|---|---|---|
| 223320 | 7/1959 | Australia | 75/772 |
| 8546 544 | 5/1986 | Australia . | |
| 890342 | 1/1972 | Canada . | |
| 0203855 | 3/1986 | European Pat. Off. . | |
| 0225171 | 10/1987 | European Pat. Off. . | |
| 0296068 | 12/1988 | European Pat. Off. . | |
| 0376713 | 7/1990 | European Pat. Off. . | |
| 427 605 | 5/1991 | European Pat. Off. . | |
| 3713883 | 11/1988 | Germany . | |
| 097237 | 8/1977 | Japan . | |
| 030053 | 11/1979 | Japan . | |
| 149195 | 12/1988 | Japan . | |
| 7706 166 | 10/1977 | South Africa . | |
| 667891 | 8/1981 | U.S.S.R. . | |
| 857285 | 8/1981 | U.S.S.R. | 75/772 |
| 88/00232 | 1/1988 | WIPO . | |

OTHER PUBLICATIONS

*Heinemann Educational Books Ltd.*, D.F. Ball et al., "Agglomeration of Iron Ores", London, Chapter 29 (1973) pp. 303–304. Month Unavailable.

*Brazil Pedidio PI*, De Oliveira, et al., "Agglomeration of Ferrous Minerals with Lignin", Brazil, p. 23, Jul. 28, 1981. (Abstract Only).

*People's Republic of China—Faming Zhuanli Shenquing Gongkai Shuomingshu*, Tang et al., "Direct Reduction of Pellets Bound with High Molecular Weight Substances", pp. 6, 1986. (Abstract only) Month Unavailable.

*Visn. L'viv. Politekh. Inst.*, Klimenko, Z.G. USSR, "Production of Nonsintered Ore Pellets Using Special Binders", pp. 139, 165–6, 1980. (Abstract only) Month Unavailable.

Gershov, I. Yu et al, "Prepn. of Barium Ferrites Using NA Carboxynethylcellulose As Binder", Jul. '68, Russia, pp. 205,982. (Chem. Abstract No. 22,244Q.).

*Primary Examiner*—Melvyn Andrews

*Attorney, Agent, or Firm*—Ralph J. Mancini; Louis A. Morris

[57] ABSTRACT

The present invention generally relates to a process of agglomerating particulate material in the presence of water which comprises mixing said particulate matreial with a binding effective amount of at least one water soluble polymer, and a binder enhancing effective amount of caustic, to produce a mixture, and forming said mixture into agglomerates.

12 Claims, No Drawings

PROCESS FOR AGGLOMERATING PARTICULATE MATERIAL

BACKGROUND OF THE INVENTION

The present invention relates to a novel binder composition for agglomerating particulate materials, a novel process for agglomerating particulate materials using said binder composition, and to the agglomerated products produced from said process. The process is particularly useful for agglomerating metallic ores such as iron ore.

Agglomeration is commercially used in industries where materials are encountered in a form which is too finely divided for convenient processing or handling. Thus, there is a need to upgrade the size, density and/or uniformity of finely divided particles for more efficient handling, processing or recovery. Agglomeration is particularly useful in the metal refining industry, where the concentrate ore encountered is typically finely divided.

Many processes for the agglomeration of particles, especially metallic particles, are known in the art. In the mining industry it is common practice to agglomerate or pelletize finely ground mineral ore concentrate to facilitate shipping of the ore. After the mineral ore has been mined, it is frequently wet ground, though not always the case, and screened to remove large particles which can be recycled for further grinding. The screened mineral ore is known in the art as "concentrate".

After screening, a binding agent is added to the wetted mineral ore concentrate and the binder/mineral ore composite is conveyed to a balling drum or other means for pelletizing the ore. The binding agent serves to hold or bind the mineral ore together until after firing. After the balling drum operation, the pellets are formed, but they are still wet. These wet pellets are commonly referred to as "green pellets." or "green balls". These green pellets are thereafter transported to a kiln and heated in stages to a end temperature of about 2400° F.

For many years, bentonite clay was the binding agent of choice in the pelletizing operations for mineral ore concentrates. Use of bentonite as a binding agent produces balls or pellets having a very good wet and dry strengths and also provides a desired degree of moisture control. Use of bentonite does, however, have several disadvantages. Initially, bentonite adds to the silica content of the pellets when the ore pellets are fired at a temperature of 2400° F. or higher. Higher amounts of silica are not desirable because silica decreases the efficiency of blast furnace operations used in smelting the ore.

The use of bentonite to form pellets of mineral ore concentrates can also add alkalis which are oxides of, for example, sodium and potassium. The presence of alkalis in the blast furnace causes both the pellets and coke to deteriorate and to form scabs on the furnace wall, which increases fuel consumption and decreases the productivity of the smelting operation.

Organic binders have proven to be an attractive alternative to bentonite because organic binders do not increase the silica content of the ore and they impart physical and mechanical properties to the pellets comparable with those of bentonite. Organic binders also burn out during ball firing operations thus causing an increase in the microporosity of the pellets. Accordingly, the pore volume and surface/mass ratio of the formed pellets produced using organic binders is larger than that of pellets produced using bentonite. Due to the larger surface area and increased permeability of the pellets produced using organic binders, the reduction of metallic oxides such as iron oxide is more efficient than with pellets prepared with bentonite.

Examples of some commonly mentioned organic binders include polyacrylate, polyacrylamide and copolymers thereof, methacrylamide, polymethacrylamide, cellulose derivatives such as alkali metal salts of carboxymethyl cellulose and carboxymethylhydroxyethyl cellulose, poly (ethylene oxide), guar gum, dairy wastes, starches, dextrins, wood related products, alginates, pectins, and the like.

U.S. Pat. No. 4,751,259 discloses compositions for iron ore agglomeration which comprise 10–45% by weight of a water-in-oil emulsion of a water soluble vinyl addition polymer, 55–90% by weight of a polysaccharide, 0.001–10% by weight of a water soluble surfactant and 0–15 weight % of Borax.

U.S. Pat. No. 4,948,430 discloses a binder for the agglomeration of ore in the presence of water, which comprises 10%–90% of a water soluble sodium carboxymethylhydroxyethyl cellulose and 10% to 90% of sodium carbonate.

U.S. Pat. No. 4,288,245 discloses pelletization of metallic ores, especially iron ore, with carboxymethyl cellulose and the salt of a weak acid.

U.S. Pat. No. 4,863,512 relates to a binder for metallic containing ores which comprises an alkali metal salt of carboxymethyl cellulose and sodium tripolyphosphate.

European Patent Application Publication No. 0 376 713 discloses a process for making pellets of particulate metal ore, particularly iron ore. The process comprises mixing a water-soluble polymer with the particular metal ore and water and pelletizing the mixture. The water-soluble polymer may be of any typical type, e.g., natural, modified natural or synthetic. The mixture may optionally comprise a pelletizing aid which may be sodium citrate.

Organic binder compositions, such as those mentioned above, are not, however, without their own disadvantages. While they are effective binders, they generally do not impart adequate dry strength to the pellets at economical use levels. Thus, there is an ongoing need for economical binders with improved properties.

SUMMARY OF THE INVENTION

The present invention generally relates to a process for agglomerating particulate material in the presence of water which comprises mixing said particulate material with a binding effective amount of at least one water soluble polymer, and a binder enhancing effective amount of caustic to produce a mixture, and forming said mixture into agglomerates.

In another embodiment, the present invention contemplates a binder composition useful for the agglomeration of particulate material in the presence of water which comprises a binding effective amount of at least one water soluble polymer and a binder enhancing effective amount of caustic.

DETAILED DESCRIPTION OF THE INVENTION

The present invention generally relates to a process of agglomerating particulate materials, especially metal containing ores, in the presence of water. The process comprises mixing said particulate material with a binding effective amount of at least one polymer and a binder enhancing effective amount of caustic to produce a mixture, and thereafter or contemporaneously forming said mixture into agglomerates.

In the context of the present invention, the present inventors have found that the addition of caustic, in either liquid or powdered form, to the mineral ore, as an integral part of the organic binder or as a separate entity, unexpectedly provides a synergistic effect in the pelletization process, giving the resultant pellets superior wet drop numbers and dry crush strength compared to pellets formed without the use of caustic. This increase in performance obtained by the addition of caustic allows the user to effectively reduce the amount of organic binder required thus significantly reducing total binder cost.

The term "agglomerated" or "agglomeration" as used in the context of the present invention shall mean the processing of finely divided materials, whether in powder, dust, chip, or other particulate form, to form pellets, granules, briquettes, and the like.

The particulate material which may be agglomerated in accordance with this present invention may be almost any finely divided material including metallic minerals or ore. The predominant metal component in said ore may be iron, chrome, copper, nickel, zinc, lead, uranium, borium and the like. Mixtures of the above materials or any other metal occurring in the free or molecularly combined material state as a mineral, or any combination of the above, or other metals, or metal containing ores capable of pelletization, may be agglomerated in accordance with the present invention. The present invention is particularly well adapted for the agglomeration of materials containing iron, including iron ore deposits, ore tailings, cold and hot fines from a sinter process or aqueous iron ore concentrates from natural sources or recovered from various processes. Iron ore or any of a wide variety of the following minerals may form a part of the material to be agglomerated: taconite, magnetite, hematite, limonite, goethite, siderite, franklinite, pyrite, chalcopyrite, chromite, ilmenite and the like.

Minerals other than metallic minerals which may be agglomerated in accordance with the invention include phosphate rock, talc, dolomite, limestone and the like. Still other materials which may be agglomerated in accordance with the present invention include fertilizer materials such as potassium sulfate, potassium chloride, double sulfate of potassium and magnesium; magnesium oxide; animals feeds such as calcium phosphates; carbon black; coal fines; catalyst mixtures; glass batch mixtures; borates, tungsten carbide; refractory gunning mixes; antimony, flue dust from, for example, power generating plants, solid fuels such as coal, coke or charcoal, blast furnace fines and the like.

The water-soluble polymer(s) useful in the present invention include but are not limited to:

(1) Water-soluble natural polymers such as guar gum, starch, alginates, pectins, xanthan gum, dairy wastes, wood related products, lignin and the like;

(2) Modified natural polymers such as guar derivatives (e.g. hydroxypropyl guar, carboxymethyl guar, carboxymethylhydroxypropyl guar), modified starch (e.g. anionic starch, cationic starch), starch derivatives (e.g. dextrin) and cellulose derivatives such as alkali metal salts of carboxymethyl cellulose, hydroxyethyl cellulose, hydroxypropyl cellulose, carboxymethylhydroxyethyl cellulose, methyl cellulose, lignin derivatives (e.g. carboxymethyl lignin) and the like; and/or (3) Synthetic polymers (e.g. polyacrylamides such as partially hydrated polyacrylamides; polyacrylates and copolymers thereof; polyethylene oxides, and the like). The foregoing polymers may be used alone or in various combinations of two or more polymers. Water-soluble anionic polymers are a preferred class of polymers to be employed in the present invention.

Preferred polymers for use in the present invention are alkali metal salts of carboxymethyl cellulose. Any substantially water-soluble alkali metal salt of carboxymethyl cellulose may be used in this invention. The sodium salt is, however, preferred. Alkali metal salts of carboxymethyl cellulose, more particularly sodium carboxymethyl cellulose, are generally prepared from alkali cellulose and the respective alkali metal salt of monochloroacetic acid. Cellulose which is used in the manufacture of sodium carboxymethyl cellulose is generally derived from wood pulp or cotton linters, but may be derived from other sources such as sugar beet pulp, bagasse, rice hulls, bran, microbially-derived cellulose, and waste cellulose e.g. shredded paper). The sodium carboxymethyl cellulose used in the present invention generally has a degree of substitution (the average number of carboxymethyl ether groups per repeating anhydroglucose chain unit of the cellulose molecule) of from about 0.4 to about 1.5, more preferably about 0.6 to about 0.9, and most preferably about 0.7. Generally the average degree of polymerization of the cellulose furnish is from about 50 to about 4000. Polymers having a degree of polymerization on the higher end of the range are preferred. It is more preferred to use sodium carboxymethyl cellulose having a Brookfield viscosity in a 1% aqueous solution of more than 2000 cps at 30 rpm, spindle #4. Still more preferred is sodium carboxymethyl cellulose having a Brookfield viscosity in a 1% aqueous solution of more than about 4,000 cps at 30 rpm, spindle #4.

A series of commercially available binders containing sodium carboxymethyl cellulose especially useful in the present invention is marketed by the Dreeland, Inc. of Virginia, Minn., Denver, Colo., and Akzo Chemicals of Amersfoort, the Netherlands, under the trademark Peridur®.

The "binding effective amount of polymer" will vary depending upon numerous factors known to the skilled artisan. Such factors include, but are not limited to, the type of particulate material to be agglomerated or pelletized, the moisture content of the particulate material, particle size, the agglomeration equipment utilized, and the desired properties of the final product, e.g. dry strength (crush), drop number, pellet size and smoothness. Though not limiting, a binding effective amount of polymer will typically be in the range of between about 0.01% to 1% by weight based on the dry weight of the mixture of particulate material, polymer and caustic. Preferably, the polymer is present in a range of between about 0.01 to 0.4% by weight, and most preferred, about 0.04%.

As used herein, the term "caustic" shall mean any source of hydroxide ions ($OH^-$) including, but not limited to sodium hydroxide, potassium hydroxide, ammonium hydroxide, calcium hydroxide, barium hydroxide, magnesium hydroxide, mixtures thereof and the like. Sodium hydroxide, commonly known as caustic soda, is the most preferred caustic.

A "binder enhancing effective amount of caustic" depends on the same factors as does the binding effective amount of polymer. Without wishing to be bound to any particular limitation, a binding effective amount of caustic will typically be in the range of between about 0.004% to 0.15% by weight based on the dry mixture of particulate material, polymer and caustic. Preferably, caustic is present in the range of between about 0.01% to 0.04% by weight, and most preferred at about 0.03% by weight.

In another embodiment, the present invention contemplates a process of agglomerating particulate material in the presence of water which comprises mixing said particulate material with between about 0.01% to 1% by weight of at least one water soluble polymer selected from hydroxyethyl cellulose, alkali metal salts of carboxymethyl cellulose, methyl cellulose, methylhydroxyethyl cellulose and mixtures thereof, and 0.004% to 0.15% by weight of sodium hydroxide to produce a mixture, and forming said mixture into agglomerates.

In still another embodiment, the present invention contemplates a process of agglomerating iron ore wherein said ore is mixed with between about 0.01 to 0.4% by weight of an alkali metal salt of carboxymethyl cellulose, from about 0.01 to 0.04% by weight sodium hydroxide, and from about 0.02–0.5 wt % (based on dry ore) of soda ash, to produce a mixture, and forming said mixture into agglomerates.

Agglomerated particulate materials formed from any of the foregoing processes is also deemed to be within the scope of the present invention.

The present invention also contemplates a binder composition useful for the agglomeration of particulate materials. The binder composition comprises a binding effective amount of at least one water soluble polymer, and a binder enhancing effective amount of caustic.

In a preferred embodiment, the present invention contemplates a binder composition which comprises between about 10% to 95% by weight of a water soluble polymer and between about 2% to 50% by weight of caustic (wt % binder composition).

In another preferred embodiment, the present invention contemplates a binder composition useful for the agglomeration of iron ore in the presence of water which comprises between about 45% to 95% by weight of a water-soluble alkali metal salt of carboxymethyl cellulose and 10% to 40% by weight of sodium hydroxide.

In yet another embodiment, the present invention contemplates a binder composition which comprises between about 50% to 80% by weight of an alkali metal salt of carboxymethyl cellulose, between about 10% to 35% by weight of caustic, and between about 2% to 20% by weight of a salt of a weak acid, such as sodium citrate and or soda ash.

The binder composition of the present invention may also contain other substances, for instance, those that are formed as by-products in the preparation of the alkali metal salt of carboxymethyl cellulose, such as sodium chloride and sodium glycolate, as well as other polysaccharides or synthetic water-soluble polymers and other "inorganic salts" (for want of a better term sodium carbonate, sodium citrate, and the like are referred to as "inorganic salts" herein). Exemplary polysaccharides include, e.g., hydroxyethyl cellulose, hydroxypropyl cellulose, carboxymethylhydroxyethyl cellulose, methyl cellulose, hydroxypropyl methyl cellulose, guar, hydroxpropyl guar and sugar beet pulp, and the like. Exemplary synthetic water-soluble polymers include partially hydrated polyacrylamide, polyvinyl alcohol, styrene/maleic anhydride copolymers, and polyacrylate and copolymers thereof, etc. Exemplary inorganic salts include, e.g. the salts described by Roorda in U.S. Pat. Nos. 4,288,245 and 4,597,797 such as sodium citrate, soda ash, and the like.

The ratios of polymer, e.g. alkali metal salt of carboxymethyl cellulose, caustic and water to particulate material, e.g. concentrated ore are dependent on various factors including the agglomeration method used, the material to be agglomerated and the desired properties of the agglomerates to be prepared. A person of ordinary skill in the art can readily determine the specific amounts that will be most suitable for individual circumstances. Pelletization is generally carried out using the binder composition in an amount of from about 0.0044% to about 0.44%, preferably from about 0.022% to about 0.22% (by weight of the total dry mixture), of the binder composition and about 2% to about 20%, preferably about 5% to about 15%, water, by weight of the total dry mixture. In addition to the binder composition, clays such as bentonite clay may be used in pelletization. The total amount of these clays will depend on the user's objectives, but will generally be less than 0.22%, based on the weight of the total dry mixture.

Any known method for forming dry pellets or particles can be used to prepare the agglomerates of this invention. For instance, the concentrated ore may be agglomerated into particles or agglomerates by rotating the concentrated ore powder in a drum or disc with a binder and water, followed by drying and firing. Agglomerates can also be formed by briquetting, nodulizing, or spray drying.

Addition of the binder composition constituents may be carried out in any manner commonly applied in the art. For instance, the binder constituents may be mixed as solid matter with the concentrated ore in a dry or liquid form or as an emulsion or dispersion. Further, they may be simultaneously, successively or alternatively added to the concentrated ore before or during the pelletizing treatment. In a preferred method, liquid caustic is sprayed on moist concentrated ore resulting from the aforementioned separation process, which has all but about 10 wt % of the water removed by, e.g. rotating disc filter. At a sufficient point upstream from the agglomerating drum or disc, the polymeric binder composition is applied so that the binder components and concentrated ore are well mixed and adequately hydrated prior to being formed into green pellets. As non-limiting ranges, the water content should generally be in the range of about 4 to 30 wt % based on the weight of dry particulate matter and most preferably between about 7 and 12 wt %.

Other substances may also be optionally added to the binder composition of the present invention. For example, in iron ore pelletizing operations, small amounts of flux, e.g., limestone or dolomite may also be added to enhance mechanical properties of the pellets. The flux also helps to reduce the dust level in the indurating furnace when the pellets are fired. Olivine, serpentine, magnesium and similar minerals may be used to improve metallurgical properties of the pellets.

Drying the wet balls and firing the resultant dry balls may be carried out as one continuous or two separate steps. The important factors are that the balls must be dry prior to firing as the balls will degrade or spall if fired without first drying them. It is therefore preferred that the balls be heated slowly to a temperature of at least about 2200° F., preferably to at least about 2400° F. and then fired at that temperature. In another embodiment, they are dried at low temperatures, preferably by heating, or alternatively, under ambient conditions, and then fired at a temperature of at least about 2200° F., more preferably at about 2400° F. Firing is carried out for a sufficient period of time to bond the small particles into pellets with enough strength to enable transportation and/or further handling, generally about 15 minutes to about 3 hours.

The process of the present invention is preferably employed with concentrated iron ore. This process is also suitable for non-ferrous concentrated ores such as ores of zinc, lead, tin, nickel and chromium and oxidic materials such as silicates and quartz, and sulphidic materials. As a practical matter, this invention is intended for use in binding the concentrated ores which result from separation of the host rock from the ore removed from the ground. However, it can also be used to bind natural ores.

The pellets resulting from this process are dry, hard agglomerates having sizes that are suitable for, e.g. shipping, handling, sintering, etc. Pellets generally have an average diameter of about ¼ to about 1 inch, preferably about ½ inch. Pellet size is generally a function of the user and operator's preference, more than of binding ability of the compositions of this invention and virtually any size pellet desired by blast furnace operations and mine operations can be prepared.

The invention is further described by the following non-limiting examples. For the purpose of characterizing the agglomerates formed, use is made of the following procedure and test protocol.

AGGLOMERATE FORMATION

The process was begun by placing 2500 grams (calculated as dry weight) of iron ore concentrate (moisture content approximately 9 to 10 wt. %) into a Mullen Mixer (Model No. 1 Cincinnati Muller, manufactured by National Engineering Co.).

Caustic was thereafter evenly sprayed on the iron ore in liquid form, diluted from either a 10 Normal solution or sodium hydroxide pellets (97+%), both purchased from Fisher Scientific. The addition rate of the diluted caustic was carefully monitored and represented in the examples as pounds dry caustic added per long ton dry concentrate (#/LTDC).

After caustic addition, polymer is then added to the mixer and spread evenly over the iron ore concentrate. If a mixture of polymers was used, the mixture was premixed by hand prior to addition to the muller mixer. The loaded mixer was run for three (3) minutes to evenly distribute the polymer. The resulting concentrate mixture was screened to remove particles smaller than those retained on an 8 mesh wire screen.

A balling disc fabricated from an airplane tire (approx. 16" diameter) driven by a motor having a 60 RPM rotational speed was employed to produce green balls of the concentrate mixture. Pellet "seeds" were formed by placing a small portion of the screened concentrate mixture in the rotating balling tire and adding atomized water to initiate seed growth. As the size of the seed pellets approached 4 mesh, they were removed from the balling disc and screened. The seed pellets with a size between 4 and 6 mesh were retained. This process was repeated if necessary until 34 grams of seed pellets were collected.

Finished green balls were produced by placing the 34 grams of seed pellets of size between 4 and 6 mesh into the rotating tire of the balling disc and adding portion of the remaining concentrate mixture from the muller mixer over a 4 minute growth period. Atomized water was added if necessary. When the proper size was achieved (−0.530 inch, +0.500 inch) concentrate mixture addition ceased and the pellets were allowed a 30 second finishing roll. The agglomerated pellets were removed from the disc, screened to −0.530, +0.500 inch size and stored in an air-tight container until they were tested.

Test Protocol

Wet Drop Number was determined by repeatedly dropping two groups of ten (10) pellets each from an 18 inch height to a steel plate until a crack appeared on the surface of each pellet. The number of drops required to produce a crack on the surface of each pellet was recorded. The average of all 20 pellets was taken to determine the drop number of each agglomerated mixture.

Dry Crush Strength was determined by drying twenty (20) pellets of each agglomerated mixture to measure the moisture content. The dry pellets were then individually subjected to a Chatilion Spring Compression Tester, Model LTCM (25 pound range) at a loading rate of 0.1 inch/second. The dry strength report for each agglomerate mixture is the average cracking pressure of the twenty pellets.

The following samples demonstrate processes and the binders of the present invention employing various polymers with sodium hydroxide and other $OH^-$, as binding agents for particulate material, which is iron ore unless otherwise specified.

EXAMPLE 1

In this example, a pure sodium carboxymethyl cellulose (CMC) polymer binder was employed (Peridur®300Z)with and without the addition of caustic. Table 1, below clearly shows that the performance of the pure CMC binder is tremendously improved by the addition of caustic.

TABLE 1

| PURE CMC #/LTDC | NaOH #/LTDC | Moisture | Wet Drop | Dry Crush (Lbs) |
|---|---|---|---|---|
| 1.0 | — | 9.9 | 8.2 | 5.3 |
| 1.0 | .12 | 10.3 | 10.5 | 7.7 |
| 1.0 | .24 | 10.1 | 11.1 | 10.6 |
| 1.0 | 1.2 | 10.0 | 9.5 | 11.9 |
| 1.0 | 2.4 | 9.7 | 7.3 | 8.8 |
| 1.0 | 4.0 | 9.2 | 5.6 | 8.0 |

# = Pounds
LTDC = Long ton dry concentrate

The data of Table 1 clearly show that the performance of pure CMC is greatly enhanced by the addition of NaOH. In this case, there is an optimum level of NaOH addition at between about 0.24 to 1.2 #/LTDC. When excessive amounts of caustic are added, the wet drops start to decrease, probably from binder deterioration at higher pH levels.

EXAMPLE 2

A technical grade CMC containing up to about 25% salt byproducts (Peridur 200®)was also tested with and without the addition of caustic. Table 2, below, contains the data.

TABLE 2

| Technical Grade CMC #/LTDC | NaOH #/LTDC | Moisture | Wet Drop | Dry Crush (Lbs) |
|---|---|---|---|---|
| .90 | — | 10.2 | 6.6 | 1.7 |
| .90 | .12 | 10.5 | 7.9 | 2.1 |
| .90 | .24 | 10.4 | 8.5 | 3.2 |
| .90 | 1.2 | 10.1 | 8.9 | 7.5 |
| .90 | 2.4 | 10.1 | 8.4 | 7.2 |

The data clearly shows that the addition of caustic greatly improves the performance of the technical grade CMC. Like the pure grade CMC of Example 1, there is an optimum level of caustic addition wherein product performance peaks, and thereafter slowly deteriorates beyond optimum addition levels.

EXAMPLE 3

A CMC/soda ash combination was employed with and without the addition of NaOH. The CMC/soda ash combination consists of about 70 to 85% technical grade CMC and 15–30% soda ash. The data obtained is compiled in Table 3, below.

TABLE 3

| Technical Grade CMC/Soda Ash Crush (lbs) | Add'n #/LTDC | NaOH #/LTDC | Moisture | Drop # | Dry |
|---|---|---|---|---|---|
| Peridur ® 2.15 | 1.06 | — | 10.0 | 7.1 | 3.7 |
| 2.15 | 1.06 | .12 | 10.0 | 7.5 | 5.0 |
| 2.15 | 1.06 | .24 | 10.2 | 9.0 | 5.8 |
| 2.15 | 1.06 | 1.2 | 10.0 | 8.2 | 7.8 |
| 2.15 | 1.06 | 2.4 | 9.9 | 7.0 | 7.4 |
| Peridur ® 3.15 | 1.0 | — | 9.5 | 4.6 | 2.2 |
| 3.15 | 1.0 | .24 | 9.7 | 5.4 | 5.2 |
| 3.15 | 1.2 | — | 9.5 | 5.0 | 3.0 |
| 3.15 | 1.2 | .24 | 9.7 | 6.4 | 7.2 |
| Peridur ® 3.30 | 1.0 | — | 9.4 | 4.3 | 2.7 |
| 3.30 | 1.0 | .24 | 9.6 | 4.7 | 5.2 |
| 3.30 | 1.2 | — | 9.2 | 4.5 | 4.2 |
| 3.30 | 1.2 | .24 | 9.6 | 6.1 | 6.7 |

*Peridur ® 2.15, Peridur ® 3.15 and Peridur ® 3.30 are binder compositions commercially available from Dreeland, Inc., Virginia, MN, Denver CO, and Akzo Chemicals, Amersfoort, the Netherlands.

The data clearly show that in every instance of caustic addition, there was an improvement in the pellet quality as compared to the pellets formed with no caustic addition.

EXAMPLE 4

In this trial, applicants tested a series of anionic polymers, including polymers of polyacrylamide (PL1400®); POLY-ACRYLATE (FP 100®), CM GUAR carboxymethyldihydroxypropyl cellulose (CMDHPC), carboxymethylhydroxyethyl cellulose (CMHEC), and, Stabilose® LV, a carboxymethyl starch (CM Starch) with and without caustic addition. The data is tabulated in Table 4 below.

TABLE 3

| Product Crush (lbs) | Add'n #/LTDC | NaOH #/LTDC | Moisture | Drop # | Dry |
|---|---|---|---|---|---|
| PAM (PL 1400) ® | 1.1 | — | 10.8 | 5.5 | 1.6 |
| PAM (PL 1400) | 1.1 | .24 | 11.3 | 6.9 | 1.9 |
| PAM (PL 1400) | 1.1 | 1.2 | 11.0 | 7.2 | 3.4 |
| PAA (FP 100 ® ) | 1.0 | — | 9.1 | 2.9 | 2.5 |
| PAA (FP 100) | 1.0 | 1.2 | 9.3 | 2.9 | 5.3 |
| CM-GUAR | 1.0 | — | 10.0 | 7.0 | 1.7 |
| CM-GUAR | 1.0 | .12 | 10.2 | 8.8 | 2.3 |
| CM-GUAR | 1.0 | .24 | 10.1 | 6.9 | 2.7 |
| CM-GUAR | 1.0 | .43 | 9.9 | 7.7 | 3.1 |
| CM-GUAR | 1.0 | .72 | 9.9 | 3.2 | 2.3 |
| CM-GUAR | 1.0 | 1.2 | 9.4 | 2.3 | 2.0 |
| CMDHPC | 1.0 | — | 8.9 | 2.7 | 1.3 |
| CMDHPC | 1.0 | .24 | 9.1 | 2.6 | 1.7 |
| CMHEC | 1.0 | — | 9.2 | 3.6 | 1.4 |
| CMHEC | 1.0 | .24 | 9.6 | 4.2 | 2.4 |
| CMHEC | 1.0 | 1.2 | 9.5 | 3.5 | 3.6 |
| CM-Starch | 2.0 | — | 9.7 | 3.3 | 3.3 |
| CM-Starch | 2.0 | .48 | 9.8 | 4.3 | 7.1 |

*PL1400 ® is a polyacrylamide commercially available from Stockhausen, Inc.
*FP100 ® is a polyacrylate commercially available from Polyacryl Inc.
*HP-8 is produced and sold by Hi-Tek Polymers.
*Guar 5200 is available through Economy Mud Products.

The polyacrylamide (PL140®), the polyacrylate (FP100®), CMDHPC, CMHPC, and CM- Starch showed benefits throughout the addition of caustic. This was not the case with the CM-Guar. Small additions of caustic significantly improved performance, however when the dosage of caustic was increased beyond optimum levels, both the wet and dry strengths were destroyed.

EXAMPLE 5

Non-ionic polymers have also been considered for use a binders. These polymers include, but are not limited to hydroxyethyl cellulose (HEC), methyl hydroxyethyl cellulose (Meth. HEC), hydroxypropyl cellulose (HPC), starch, dextrin, guar (guar 5200), and hydroxypropyl guar (HPG). Caustic addition to these binders was also investigated and the data is tabulated in Table 5, below.

TABLE 5

| Polymer | Add'n #/LTDC | NaOH #/LTDC | Moisture | Drop # | Dry Crush (lbs) |
|---|---|---|---|---|---|
| HEC | 1.0 | — | 9.6 | 7.7 | 2.9 |
| HEC | 1.0 | .24 | 9.9 | 11.1 | 3.4 |
| HEC | 1.0 | 1.2 | 10.1 | 10.7 | 3.6 |
| Meth.HEC | 1.0 | — | 9.7 | 5.9 | 4.3 |
| Meth.HEC | 1.0 | .24 | 9.9 | 7.0 | 4.6 |
| HPC | 1.0 | — | 9.9 | 6.1 | 2.6 |
| HPC | 1.0 | .24 | 10.9 | 6.7 | 3.0 |
| Starch | 4.0 | — | 9.8 | 4.1 | 5.8 |
| Starch | 4.0 | .24 | 10.1 | 4.7 | 5.7 |
| Dextrin | 4.0 | — | 8.5 | 2.5 | 4.9 |
| Dextrin | 4.0 | .24 | 9.2 | 2.8 | 4.8 |
| Guar 5200 | 1.0 | — | 10.7 | 4.6 | 1.8 |
| Guar 5200 | 1.0 | .24 | 9.7 | 3.8 | 1.4 |
| HPG (HP8) | 1.0 | — | 11.3 | 7.7 | 2.0 |
| HPG (HP8) | 1.0 | .24 | 9.5 | 2.7 | 1.5 |

The data clearly demonstrate that the cellulosics all showed some improvement, albeit the improvements were not as great as those seen with anionic binders.

The starch and dextrin binders tested showed no improvement in wet drop numbers and dry strengths.

EXAMPLE 6

To determine whether or not caustic itself may be contributing to the dry strength of pellets by forming its own binder bridges, iron ore was pelletized using only caustic. The data is compiled in Table 6 below.

TABLE 6

| NaOH Add'n | Moisture | Drop # | Dry Crush (lbs) |
|---|---|---|---|
| — | 8.9 | 2.3 | .8 |
| .4#/LTDC | 9.2 | 2.6 | 1.6 |

The data show that NaOH provides some, but minimal binding action when employed alone.

EXAMPLE 7

All previous testing employed only NaOH as a source of $OH^-$ ions. The present example investigates the use of other metal hydroxides for synergistic effect. The results are tabulated in Table 7.

TABLE 7

| Peridur 300 ® Crush #/LTDC (lbs) | Hydroxide Source | Add'N #/LTDC | Moisture | Drop # | Dry |
|---|---|---|---|---|---|
| 1.0 | KOH | .45 | 10.0 | 5.4 | 2.8 |
| 1.0 | $NH_4OH$ | 1.46 | 10.0 | 6.4 | 3.3 |

TABLE 7-continued

| Peridur 300 ® Crush #/LTDC (lbs) | Hydroxide Source | Add'N #/LTDC | Moisture | Drop # | Dry |
|---|---|---|---|---|---|
| 1.0 | $Mg(OH)_2$ | .45 | 9.9 | 4.3 | 1.9 |
| 1.0 | — | — | 10.0 | 5.0 | 1.8 |

With the potassium hydroxide (KOH) and the ammonium hydroxide, ($NH_4OH$) improvements, most noticeably in the dry crush, were seen. This was not the case with the magnesium hydroxide $Mg(OH)_2$, which appeared to deteriorate the surface conditions on the pellet, turning the green ball rough and wet.

The results seen with the magnesium hydroxide were not unexpected. It is known that any divalent cation will react with the CMC and cause a decrease in viscosity and/or performance. The $NH_4$+ and K+ ions resulting from the other two hydroxides are monovalent cations and cause no adverse effects.

While NaOH appears to outperform the other metal hydroxides, both KOH and $NH_4OH$ seem to exhibit some synergism to the binding mechanism.

EXAMPLE 8

All previous examples employed only iron ore from a taconite source from northern Minnesota. Several other types of ore bodies abound, most notably the specular hematites in eastern Canada and the magnetite ores in Sweden. Tests were run employing a specular hematite ore from IOC and a magnetite ore from LKAB. The results are tabulated in Table 8, below.

TABLE 8

| ORE | Peridur 300 ® #/LTDC | NaOH #/LTDC | Moisture | Drop # | Dry Crush |
|---|---|---|---|---|---|
| IOC | 1.0 | — | 8.8 | 8.1 | 2.7 |
| IOC | 1.0 | .24 | 9.0 | 9.4 | 4.0 |
| LKAB | 1.2 | — | 9.4 | 5.0 | 4.8 |
| LKAB | 1.2 | .24 | 9.5 | 7.2 | 7.1 |

The data clearly show that other ore sources demonstrate the same type of synergism exhibited by the taconite ore source.

The foregoing data clearly demonstrate the synergistic results of the present binder composition, which supports the patentability of the present invention.

The foregoing examples have been presented to demonstrate the surprising and unexpected superiority of the present invention in view of known technology, and said examples are not intended to restrict the spirit and scope of the following claims.

We claim:

1. A process for agglomerating particulate material comprising:

(a) pretreating said particulate material with a binder enhancing effective amount of a liquid spray of a source of hydroxide ions;

(b) mixing said pretreated particulate material with a binding effective amount of a water-soluble polymer and water; and (c) forming said mixture into agglomerates.

2. The process of claim 1, wherein said water-soluble polymer is guar, guar derivatives, carboxymethyl guar, hydroxypropyl guar, carboxymethylhydroxypropyl guar, modified starch, starch derivatives, carboxymethyl starch, pregelatinized starch, alginates, pectins, polyacrylamides and derivatives thereof, polyacrylates and copolymers thereof, polyethyleneoxides, cellulose derivatives, carboxymethyl cellulose, hydroxyethyl cellulose, carboxymethylhydroxyethyl cellulose, methylhydroxyethyl cellulose, carboxymethyldihydroxypropyl cellulose, xanthan gum, dairy wastes, wood related products, lignin, or mixtures thereof.

3. The process of claim 1, wherein said source of hydroxide ions is sodium hydroxide, potassium hydroxide, ammonium hydroxide, calcium hydroxide, barium hydroxide, magnesium hydroxide or mixtures thereof.

4. The process of claim 1, wherein said particular material is a metal containing ore.

5. The process of claim 4, wherein said metal containing ore is iron ore.

6. The process of claim 1, wherein said water-soluble polymer is an alkali metal salt of carboxymethyl cellulose and said source of hydroxide ions is sodium hydroxide.

7. The process of claim 1, wherein said binder enhancing effective amount of hydroxide ions is in a range of from about 0.004% to about 0.15% by weight, based on the dry mixture of particulate material, water-soluble polymer and source of hydroxide ions.

8. The process of claim 7, wherein said range is from about 0.01% to about 0.04%.

9. The process of claim 1, wherein said binding effective amount of water-soluble polymer is in a range of from about 0.01% to about 1% by weight, based on the weight of the dry mixture Of particulate material, water-soluble polymer and source of hydroxide ions.

10. The process of claim 9, wherein said range is from about 0.01% to about 0.4%.

11. The process of claim 9, wherein said partitulate material contains about 10% by weight water.

12. The process of claim 1, wherein said water is present in an amount in a range of from about 4% to about 30% by weight, based on the weight of the dry mixture of particulate material.

* * * * *